US006052846A

United States Patent [19]

Patel et al.

[11] Patent Number: 6,052,846

[45] Date of Patent: Apr. 25, 2000

[54] METHOD OF PROVIDING AND MAINTAINING CLEAN AND SANITARY BEDSPREADS IN HOTELS

[76] Inventors: Kamal C. Patel, 267 Eversholt Street, London, United Kingdom, KW1 1BA; Rajesh Shah, 2254 Lenex Walk, Atlanta, Ga. 30319

[21] Appl. No.: 09/361,722

[22] Filed: Jul. 27, 1999

[51] Int. Cl.[7] ..... A47G 9/04

[52] U.S. Cl. ..... 5/501; 5/502

[58] Field of Search ..... 5/501, 502, 494, 5/500, 482, 484

[56] References Cited

U.S. PATENT DOCUMENTS

| | | | |
|---|---|---|---|
| 2,596,547 | 5/1952 | Guest . | |
| 2,834,033 | 5/1958 | O'Brien | 5/502 |
| 3,137,871 | 6/1964 | Florio . | |
| 3,178,734 | 4/1965 | Carrez . | |
| 3,199,123 | 8/1965 | Komiske . | |
| 3,241,161 | 3/1966 | Dashosh | 5/501 |
| 3,336,610 | 8/1967 | Geddings . | |
| 3,541,620 | 11/1997 | Chapuis . | |
| 3,563,837 | 2/1971 | Smith et al. | 5/502 |
| 3,857,124 | 12/1974 | Hadley . | |
| 3,965,504 | 6/1976 | Ainsworth . | |
| 4,339,835 | 7/1982 | Jaffe et al. | 5/413 R |
| 4,646,376 | 3/1987 | Sulley | 5/502 |
| 4,839,934 | 6/1989 | Rojas | 5/502 |
| 4,899,408 | 2/1990 | Illingsworth | 5/484 |
| 5,537,952 | 7/1996 | Devlin | 5/501 |

FOREIGN PATENT DOCUMENTS

| | | | |
|---|---|---|---|
| 2540718 | 8/1984 | France | 5/501 |
| 202811 | 5/1939 | Switzerland | 5/501 |

*Primary Examiner*—Alexander Grosz
*Attorney, Agent, or Firm*—Brown, Pinnisi & Michaels, P.C.

[57] ABSTRACT

A method of providing and maintaining a plurality of clean, sanitary bedspreads for a hostelry having sleeping accommodations for a plurality of guests. The method includes providing a plurality of bedspreads, and each bedspread includes (i) a removable liner having an insulating core and two outer layers where each outer layer is a nonabsorbent, flame retardant material, and (ii) an outer shell having two outer layers defining a pocket therebetween for removably receiving the liner. The outer shell is closed at one end and has a fastener, preferably a zipper that is enclosed and hidden by a zipper fold, along the other three sides. The method also includes covering each of a plurality of beds with each of a plurality of the described bedspreads in preparing the sleeping accommodations for the hotel guests, removing the bedspreads from the beds after use, removing the liners from the bedspreads, providing a laundered outer shell for each removed liner for which replacement on a bed is desired and inserting the liner in a laundered shell, and re-covering each of the beds with a clean bedspread.

The invention is a cost-effective method for providing clean and sanitary bedspreads in high-volume, high-turnover applications, and is therefore particularly suited for large-scale hotel operations in which laundering costs are a significant proportion of day-to-day operating costs.

6 Claims, 2 Drawing Sheets

METHOD OF PROVIDING AND MAINTAINING CLEAN AND SANITARY BEDSPREADS IN HOTELS

FIELD OF THE INVENTION

The invention pertains to a system for improved housekeeping and maintenance of clean bedding in hotels. More particularly, the invention pertains to a method for providing clean and sanitary bedspreads for hotels and other high-volume or high-turnover providers of guest accommodations.

BACKGROUND OF THE INVENTION

One of the major costs and labor-intensive aspects of maintaining a hotel capable of accommodating large numbers of guests is the maintenance of the cleanliness of guest bedding. This is a continuous and important requirement and an aspect of hotel operations that significantly factors into overhead costs.

Most hotels are conscientious in attending to everyday laundering of bedding such as sheets and pillowcases. Hotels, and even smaller establishments such as motels or bed-and-breakfasts, require laundry facilities on the premises of a size and scope capable of handling the demands of the particular establishment. The costs associated with laundry facilities can factor in significantly to the hotel's operational costs. These costs include the original purchase or lease price of the washers and dryers and other equipment, regular maintenance costs, the cost of laundry detergents and other cleaning supplies such as softeners and static removers, the cost of hot water, water, and power to run the machines, and also the various labor costs associated with the operation that includes significant time and labor in laundering bedspreads as these are currently designed. Another significant cost aspect is the increased inventory required for replacement bedspreads or while soiled bedspreads are awaiting laundering.

Consequently, whereas sheets and pillowcases generally receive the priority of everyday cleaning, bulkier bedspreads are cleaned very infrequently, for a number of reasons. One reason is that bedspreads are relatively bulky in comparison to sheets and can occupy up to ten times the volume per unit in a washer or dryer. More frequent laundering of bedspreads would therefore necessitate the purchase of additional equipment, increase the wear and frequency of breakdown of the machines, and necessitate larger laundry room spaces to accommodate the equipment, all factors that can significantly drive up hotel laundry costs.

Another reason is that the removal, handling and transporting of bulky bedspreads from guest room to laundry and back would significantly increase the workload on the hotel housekeeping staff and possibly require the use of larger and unwieldy handcarts. These could be more difficult to maneuver through hallways or into rooms and also cost more than existing handcarts. Yet another reason is that industry or state health standards have not fully addressed this issue and hotels have therefore not been forced or obligated to diligently attend to it.

There has, however, been a spate of recent publicity about the problem of unclean and unsanitary bedspreads in hotel rooms. Investigations and studies have demonstrated that bedspreads are laden with bodily fluids such as vaginal secretions and sperm, are contaminated with bacteria, body hair, and other foreign substances, and also contain vermin such as body lice and bed lice such as *Pediculus humanus*. The likelihood of a guest contracting an illness or a condition such as body lice is increased without frequent laundering of bedspreads. This is especially true in the case of resort hotels and other establishments having health clubs and swimming pools. Guests often change into bathing or swimming attire in their rooms, proceed to the pool or club, and when finished often proceed back to their rooms to change again. They may sit on the bed and on the bedspread while changing. If the bedspread is contaminated and unsanitary, a guest is more likely to contract one of these problems or conditions when partially or completely undressed and in direct contact with the bedspread.

Bedspreads commonly used in hotels are typically a one-piece construction, relatively bulky, and not water repellant. Other types of blankets, quilts, or bedspreads are known but for various reasons have not been used in high volume hotel applications.

One such design is termed a duvet cover. It has an outer shell and a removable interior layer. The shell, however, has just one opening along one side that extends to the shell bottom and then up the opposite side with the top, head portion closed. It is unduly cumbersome, however, to remove and then replace the interior layer, particularly for one person. The duvet is therefore not suitable for many large-volume, high-turnover hotel applications that require one person to service each guest room in a reasonable, cost-efficient amount of time. The duvet cover also does not provide a water or mildew-resistant liner.

Another design provides an outer shell, removable liner, a built-in pouch for a pillow, an opening at one end for inserting and removing the liner, and two openings at the opposite end for inserting one's hands to pull the liner into position. This is also a difficult and inefficient way to change the liner, and the bedspread is poorly suited for hotel use.

SUMMARY OF THE INVENTION

The invention provides a method of providing and maintaining a plurality of clean, sanitary bedspreads for a hostelry having sleeping accommodations for a plurality of guests. The method includes providing a plurality of bedspreads where each bedspread includes: (i) a removable liner that has an insulating core and two outer layers, where each outer layer is a nonabsorbent, flame retardant material; and (ii) an outer shell having two outer layers that defining a pocket therebetween for removably receiving the liner, the outer shell being closed at one end and including a fastener, preferably a zipper, along the other three sides.

The method of the invention then includes covering each of a plurality of beds with each of the plurality of bedspreads in preparing the sleeping accommodations for the guests; removing the bedspreads from the beds after use by the guests; removing the liners from the bedspreads; providing a laundered outer shell for each removed liner for which replacement on a bed is desired and inserting a liner in each of the laundered shells; and re-covering each of the beds with each of the bedspreads having a laundered outer shell containing a liner.

The invention fulfills an important need in the hotel industry by providing a practical solution to the long-standing problem of unsanitary and unclean bedspreads in guestrooms. The method of the invention provides a bedspread that is easily disassembled by one person and that is just as easily reassembled with a freshly laundered outer shell. A plurality of bedspreads can therefore be readily changed and the outer shells after removal then laundered to help eliminate the unsanitary conditions that have been an undesirable norm due to the difficulty in laundering high volumes of bulky bedspreads on a continuing basis.

The invention also provides a convenient and cost effective method of changing the pattern and/or color of the hotel's bedspreads while incurring just the expense of changing the outer shells and reusing the liners. This not only saves some of the cost of replacement of each bedspread but also encourages reuse and recycling of part of the product and therefore provides a general societal benefit.

The invention provides more sanitary bedding and sleeping accommodations for guests by the removal of contamination from bedspreads such as bodily fluids, foreign substances, and body lice or bed lice.

DESCRIPTION OF THE PREFERRED EMBODIMENTS

Figure 1:
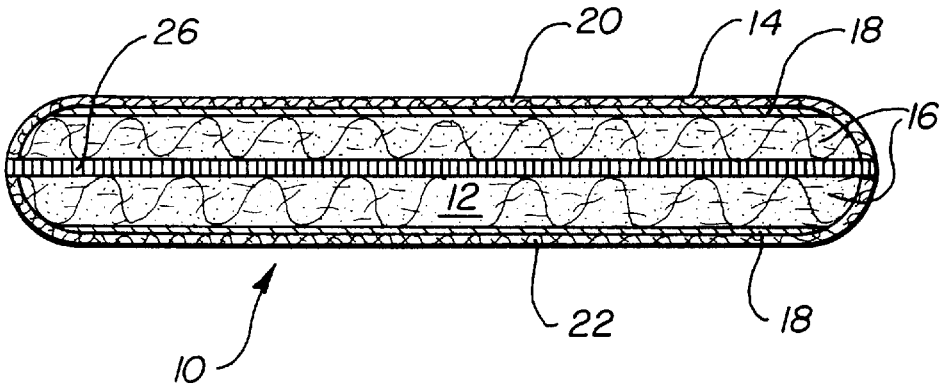
FIG. 1 shows a cross-sectional view of a bedspread according to the invention.
Figure 2:
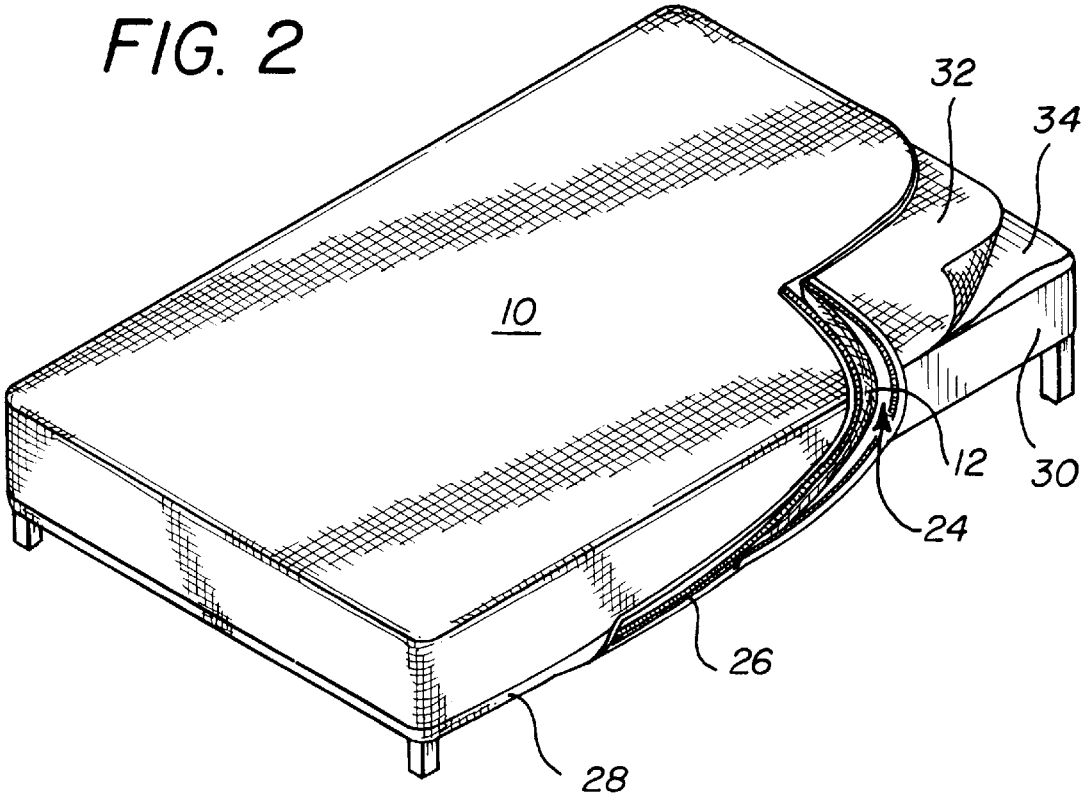
FIG. 2 shows a perspective view of a liner being removed from a bedspread when remaking a bed according to the invention.
Figure 3:
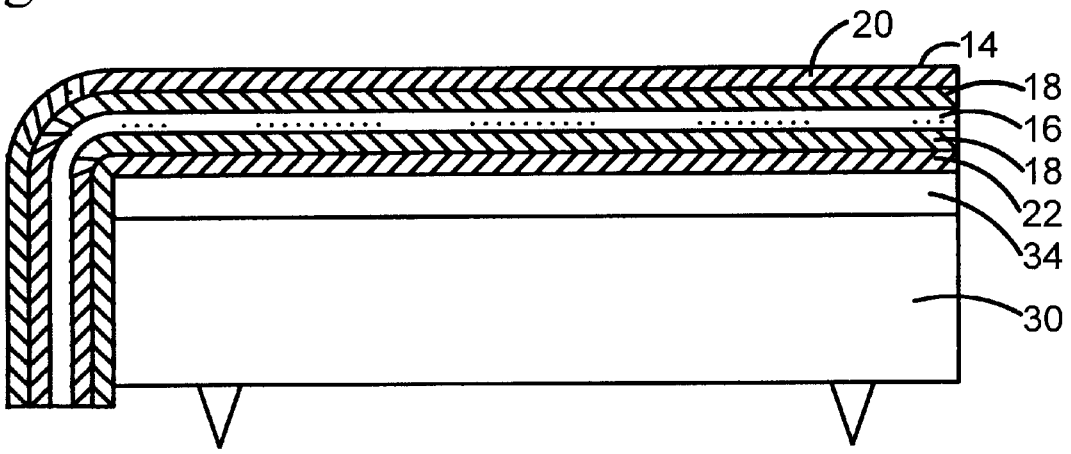
FIG. 3 shows a cross-sectional view of a bedspread on a bed according to the invention.

Referring now to FIGS. 1–3, bedspread 10 comprises removable liner 12 and outer shell 14. Liner 12 comprises core 16 and outer layers 18, the latter of which comprise a material that is nonabsorbent, flame retardant, and also preferably mildew-resistant. Layers 18 preferably comprise a wear resistant textile fabric, whether made of natural or artificial fibers or a mixture of natural and artificial fibers.

Core 16 is preferably an insulating material such as a foam. The foam is preferably a soft, pliant, low density material and accordingly not unduly stiff in order to present a sufficiently soft and flexible bedspread 10 and maximum comfort and utility to the user.

Shell 14 has outer layers 20 and 22 that define compartment 24 therebetween for removably receiving liner 12. Layers 20 and 22 are preferably joined at one end and fastened along the other three sides by zipper 26, although other convenient fasteners such as Velcro may optionally be used. Zipper 26 is preferably covered by and hidden within fold 28 to prevent contact with the user's person and lend bedspread 10 the appearance of a one-piece bedspread.

Layers 20 and 22 may be either the same material or a different material. For example, one layer may be polycotton, that is, a cotton-synthetic polyester-type blend, and the other layer cotton or some other choice of material. Layers 20 and 22 preferably have identical patterns and colors. The thickness of layers 20 and 22 should be sufficient so as to provide sufficient durability while not unduly increasing the bulk in order to maximize the number of shells 14 that can be laundered in each washing machine load.

FIG. 2 shows bedspread 10 in the process of being removed from mattress 30. Zipper 26 is opened to provide access to liner 12 and liner 12 is removed. This is easily accomplished by one person in a short time. Used shell 14 can then be set aside for cleaning, a clean shell 14 is provided, and liner 12 is placed inside clean shell 14 to produce a clean bedspread 10. Clean bedspread 10 will usually be provided at the time bed 30 is being made up with a fresh set of sheets 32 over mattress pad 34, although clean bedspread 10 may be provided when convenient or necessary or stored until use.

A hotel housekeeper can similarly change many bedspreads 10 while making up numbers of rooms and conveniently carry a number of used shells 14 on the housekeeping cart, in a laundry bag, or using other such means because the overall bulk and weight of shells 14 is much less than that of the original bedspreads 10.

Since liner 12 includes outer nonabsorbent or water repellant layers 18 it substantially resists absorption of bodily fluids, spilled fluids, and other substances that can be preferably absorbed by one or both of layers 20 and 22. Liner 12 should therefore necessitate less cleaning or replacement than shell 14 and also suffer less wear and tear. Liner 12 can also be fabricated from better wearing materials than shell 14 and have a longer natural life expectancy. Layers 18 preferably comprise a wear resistant textile fabric as discussed above with improved wearability and therefore a longer life expectancy than a cotton or polycotton material, although the latter may be appropriate materials for layers 20 and 22.

Liner 12 is thicker than shell 14 and provides the insulating feature desirable in bedspread 10. Although liner 12 can be laundered if desired, this should not be frequently necessary since it will not come into direct contact with a user and since shell 14 should absorb much of any contaminants and other substances.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A method of providing and maintaining a plurality of clean, sanitary bedspreads for a hostelry having sleeping accommodations for a plurality of guests, comprising the steps of:

providing a plurality of bedspreads, wherein each said bedspread comprises:

a removable liner, said liner comprising an insulating core and two outer layers, each said outer layer comprising a nonabsorbent, flame retardant material;

an outer shell comprising two outer layers defining a pocket therebetween for removably receiving said liner, wherein said outer shell has an end and three sides and is closed at said end and has a fastener along said three sides;

covering each of a plurality of beds with each of said plurality of bedspreads in preparing said sleeping accommodations for said guests;

removing said bedspreads from said beds after use by said guests;

removing said liners from said bedspreads; and providing a laundered outer shell for each removed liner for which replacement on a bed is desired and inserting a liner in each of said laundered shells.

2. A method as in claim 1, further comprising the step of re-covering each of said beds with each of said bedspreads having a laundered outer shell containing a liner.

3. A method as in claim 1, wherein some of said laundered shells in which a liner has been inserted are stored for future use.

4. A method as in claim 1, wherein said fastener is a zipper and said shell further comprises a fold for enclosing and hiding said zipper.

5. A method as in claim 1, wherein said one of said outer layers of said shell comprises a polyester-cotton blend and said remaining outer layer of said shell comprises cotton.

6. A method as in claim 1, wherein said outer layers of said liner are mildew resistant.

* * * * *